US010927643B2

(12) United States Patent
Ejim et al.

(10) Patent No.: US 10,927,643 B2
(45) Date of Patent: Feb. 23, 2021

(54) OPERATING A SUBSURFACE SAFETY VALVE USING A DOWNHOLE PUMP

(71) Applicant: Saudi Arabian Oil Company, Dhahran (SA)

(72) Inventors: Chidirim Enoch Ejim, Dhahran (SA); Brian A. Roth, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/400,309

(22) Filed: May 1, 2019

(65) Prior Publication Data

US 2020/0347698 A1 Nov. 5, 2020

(51) Int. Cl.
*E21B 34/08* (2006.01)

(52) U.S. Cl.
CPC ..... *E21B 34/08* (2013.01); *E21B 2200/05* (2020.05)

(58) Field of Classification Search
CPC ..... E21B 34/08; E21B 34/085; E21B 34/10; E21B 34/101; E21B 2200/05
See application file for complete search history.

(56) References Cited

U.S. PATENT DOCUMENTS 2,931,384 A * 4/1960 Clark, Jr. ..... E21B 34/08 137/498
4,425,965 A 1/1984 Bayh, III et al.
4,440,221 A * 4/1984 Taylor ..... E21B 34/08 166/106
4,632,187 A 12/1986 Bayh, III et al.
5,094,294 A 3/1992 Bayh, III et al.
5,613,311 A 3/1997 Burtch
6,289,990 B1 * 9/2001 Dillon ..... E21B 34/08 166/319
6,427,778 B1 * 8/2002 Beall ..... E21B 34/00 166/321
6,619,388 B2 9/2003 Dietz et al.
9,157,297 B2 10/2015 Williamson, Jr.
(Continued)

FOREIGN PATENT DOCUMENTS

WO WO 2012166638 12/2012
WO WO 2013089746 6/2013
(Continued)

OTHER PUBLICATIONS glossary.oilfield.slb.com [online], "Subsurface Safety Valve (SSSV)," available on or before Feb. 26, 2013, via Internet Archive: Wayback Machine URL<https://web.archive.org/web/20130226223723/https://www.glossary.oilfield.slb.com/en/Terms/s/subsurface_safety_valve_sssv.aspx>, retrieved on Dec. 1, 2020, URL <https://www.glossary.oilfield.slb.com/en/Terms/s/subsurface_safety_valve_sssv.aspx>, 2 pages.

(Continued)

*Primary Examiner* — David Carroll
(74) *Attorney, Agent, or Firm* — Fish & Richardson P.C.

(57) ABSTRACT

A pressure regulator is configured to manage a pressure downstream of a pump discharge during operation. A hydraulic piston is exposed to pressure upstream of the pressure regulator during operation. The hydraulic piston extends into a first fluid reservoir. The first fluid reservoir is defined by an inner surface of an outer housing of a subsurface safety valve. A subsurface safety valve is fluidically couple to the hydraulic piston.

25 Claims, 5 Drawing Sheets

(56) References Cited

U.S. PATENT DOCUMENTS

| | | | | |
|---|---|---|---|---|
| 9,759,041 | B2 | 9/2017 | Osborne | |
| 2003/0079880 | A1* | 5/2003 | Deaton | E21B 34/10 166/332.8 |
| 2009/0001304 | A1 | 1/2009 | Hansen et al. | |
| 2012/0012327 | A1* | 1/2012 | Plunkett | E21B 34/101 166/324 |
| 2013/0048302 | A1* | 2/2013 | Gokdag | E21B 34/10 166/373 |
| 2014/0116720 | A1* | 5/2014 | He | E21B 21/10 166/373 |
| 2014/0144706 | A1* | 5/2014 | Bailey | E21B 7/00 175/57 |
| 2018/0171763 | A1* | 6/2018 | Malbrel | E21B 43/128 |

FOREIGN PATENT DOCUMENTS

| | | |
|---|---|---|
| WO | 2016050301 | 4/2016 |
| WO | 2018096345 | 5/2018 |

OTHER PUBLICATIONS

International Search Report and Written Opinion issued in International Application No. PCT/US2020/030291 dated Jul. 13, 2020, 18 pages.

* cited by examiner

OPERATING A SUBSURFACE SAFETY VALVE USING A DOWNHOLE PUMP

TECHNICAL FIELD

This disclosure relates to subsurface safety valves (SSSV).

BACKGROUND

Artificial lift methods, such as well pumps, are frequently used in the production of fluids from hydrocarbon or water wells. The main function of well pumps is to lift fluids to the surface when natural pressure in an underground reservoir is insufficient to lift the formation fluid. A typical type of well pumps is an electrical submersible pump (ESP), powered by an electric motor. An ESP is lowered into a well and operates beneath the surface of the formation fluid. ESPs are also used to increase fluid production rate from subsurface wells.

Such wellbore setups often include subsurface safety valves (SSSV). A SSSV is a downhole equipment that can be part of the completion string on which the ESP is run. SSSVs are used to enable closure of the wellbore to prevent accidental discharge of wellbore fluids to the surface. The uncontrolled release typically happens when, for example, surface equipment in a well completion are damaged and the pressure of subsurface fluids becomes sufficient to naturally lift the formation fluid to the surface. For conventional ESP systems, SSSVs are set at a shallower depth than the ESP. Deep-set SSSVs can also be used depending on whether the well is on-shore or off-shore, among other reasons.

A typical SSSV is operated by hydraulic pressure provided by a hydraulic control unit located at the surface. In this configuration, a hydraulic control line is run outside the production tubing and extends from the surface control unit to the hydraulic chamber section of the SSSV. Operation of the SSSV includes pressurizing hydraulic oil by a surface pump to open the safety valve so that formation fluids can flow to the surface. Otherwise, when no hydraulic pressure is provided from the surface to the SSSV, the SSSV is closed and the reservoir is isolated. This configuration is for a SSSV with depths in the order of 300 feet below the surface. For other scenarios, like offshore deep-water applications, the SSSV is to be set deep in a well in the order of 10000 feet or more below the surface such that the valve is above or below the packer. In such instances, operating the valve requires a higher hydraulic pressure at the valve depth and, subsequently, requires a longer length of hydraulic control line, as well as a larger surface hydraulic panel to provide the additional pressure at the surface to operate the valve. Finally, SSSV systems typically require separate controls to operate the SSSV than the control used to operate the ESP or other well pump.

SUMMARY

This disclosure describes technologies relating to operating subsurface safety valves (SSSV) using electrical submersible pumps (ESP).

An example implementation of the subject matter described within this disclosure is a subsurface safety valve system with the following features. A pressure regulator is configured to manage a pressure downstream of a pump discharge during operation. A hydraulic piston is exposed to pressure upstream of the pressure regulator during operation. The hydraulic piston extends into a first fluid reservoir. The first fluid reservoir is defined by an inner surface of an outer housing of a subsurface safety valve. A subsurface safety valve is fluidically couple to the hydraulic piston.

Aspects of the example subsurface safety valve, which can be combined with the example subsurface safety valve alone or in combination, include the following. The subsurface safety valve includes a flapper. The flapper is positioned adjacent to a sleeve. The sleeve has a shoulder around an outer circumference of the sleeve. The sleeve is positioned to retain the flapper against a flapper seat when the flapper is in a closed position. The sleeve is surrounded by a spring. The spring has a first end and a second end. The first end abuts the shoulder of the sleeve toward the flapper. The second end abuts an inner housing of the subsurface safety valve. The first fluid reservoir is fluidically coupled to a second fluid reservoir. The second fluid reservoir is defined by the inner housing of the subsurface safety valve and the sleeve.

Aspects of the example subsurface safety valve, which can be combined with the example subsurface safety valve alone or in combination, include the following. The flapper seat includes a metal seat that forms a metal-to-metal seal when the flapper is received.

Aspects of the example subsurface safety valve, which can be combined with the example subsurface safety valve alone or in combination, include the following. The flapper opens in an uphole direction during operation.

Aspects of the example subsurface safety valve, which can be combined with the example subsurface safety valve alone or in combination, include the following. The sleeve is biased in a downhole direction during operation.

Aspects of the example subsurface safety valve, which can be combined with the example subsurface safety valve alone or in combination, include the following. The first fluid reservoir and the second fluid reservoir are filled with hydraulic oil during operation.

Aspects of the example subsurface safety valve, which can be combined with the example subsurface safety valve alone or in combination, include the following. The pressure regulator includes a plunger that is positioned within a flow passage downstream of the pump discharge when in use. A biasing spring has a first end that abuts the plunger and a second end that abuts a support structure. The spring is positioned to exert a force on the plunger in an upstream direction. A plunger seat or receptacle is shaped to receive the plunger and form a seal when the plunger is received.

Aspects of the example subsurface safety valve, which can be combined with the example subsurface safety valve alone or in combination, include the following. The biasing spring sets the cracking or opening pressure of the pressure regulator.

Aspects of the example subsurface safety valve, which can be combined with the example subsurface safety valve alone or in combination, include the following. The plunger seat includes a metal seat that forms a metal-to-metal seal when the plunger is received.

Certain aspects of the subject matter described here can be implemented as a method. A pressure rise is created between an electric submersible pump discharge and a subsurface safety valve. A piston upstream of the pressure regulator is actuated in response to an increased pressure upstream of the pressure regulator. The subsurface safety valve is actuated responsive to actuating the piston.

Aspects of the example method, which can be combined with the example method alone or in combination, include the following. A plunger of a pressure regulator, upstream of the subsurface safety valve is actuated, in response to fluid flow to produce fluid to the surface.

Aspects of the example method, which can be combined with the example method alone or in combination, include the following. A sleeve assembly, which is positioned downstream of the pressure regulator, is actuated in response to actuating the piston. A flapper valve of the subsurface safety valve downstream of the pressure regulator is opened in response to a fluid flow and actuating the sleeve assembly.

Aspects of the example method, which can be combined with the example method alone or in combination, include the following. The flapper valve opens in a downstream direction.

Aspects of the example method, which can be combined with the example method alone or in combination, include the following. Managing a pressure to includes a bias spring forcing a plunger towards a plunger seat. The created pressure rise can be overcome by fluid flow holding the plunger off of the plunger seat or receptacle.

Aspects of the example method, which can be combined with the example method alone or in combination, include the following. The fluid flow through an electric submersible pump is ceased. The plunger is set against the plunger seat or receptacle in response to the ceased fluid flow. The flapper valve is set against a flapper seat. The sleeve is held against the flapper valve while the flapper valve is in a closed position.

Aspects of the example method, which can be combined with the example method alone or in combination, include the following. The sleeve assembly, which is actuated in response to actuating the piston, includes a movement of the piston pressurizing a chamber, which is hydraulically coupled to the piston. One side of the chamber is a shoulder of the sleeve assembly. The actuated sleeve assembly also includes the shoulder moving the sleeve assembly in response to the increased pressure.

An example implementation of the subject matter described within this disclosure is a wellbore production system with the following features. A production string within a wellbore. A packer surrounds the production string. The packer seals an annulus, which is defined by an outer surface of the production string and an inner surface of the wellbore. The packer fluidically separates the annulus into an uphole section and a downhole section. An electric submersible pump is positioned nearer a downhole end of the production string than an uphole end of the production string. A subsurface safety valve system is positioned onto the production string uphole of the electric submersible pump. The subsurface safety valve system includes a pressure regulator configured to manage a pressure downstream of a pump discharge during operation. The subsurface safety valve system includes a hydraulic piston that is exposed to pressure upstream of the pressure regulator during operation. The hydraulic piston extends into a first fluid reservoir. A subsurface safety valve is fluidically couple to the hydraulic piston.

Aspects of the example wellbore production system, which can be combined with the example wellbore production system alone or in combination, include the following. The subsurface safety valve includes a flapper. The flapper is positioned adjacent to a sleeve. The sleeve has a shoulder around an outer circumference of the sleeve. The sleeve is positioned to retain the flapper against a flapper seat when the flapper is in a closed position. The sleeve is surrounded by a spring. The spring has a first end and a second end. The first end abuts the shoulder of the sleeve toward the flapper. The second end abuts an inner housing of the subsurface safety valve. The first fluid reservoir is fluidically coupled to a second fluid reservoir. The second fluid reservoir is defined by the inner housing of the subsurface safety valve and the sleeve.

Aspects of the example wellbore production system, which can be combined with the example wellbore production system alone or in combination, include the following. The flapper seat includes a metal seat that forms a metal-to-metal seal when the flapper is received.

Aspects of the example wellbore production system, which can be combined with the example wellbore production system alone or in combination, include the following. The flapper opens in an uphole direction during operation.

Aspects of the example wellbore production system, which can be combined with the example wellbore production system alone or in combination, include the following. The sleeve is biased in a downhole direction during operation.

Aspects of the example wellbore production system, which can be combined with the example wellbore production system alone or in combination, include the following. The pressure regulator includes a plunger that is positioned within a flow passage downstream of the pump discharge when in use. A biasing spring has a first end abuts the plunger and a second end that abuts a support structure. The spring is positioned to exert a force on the plunger in an upstream direction. A plunger seat or receptacle is shaped to receive the plunger and form a seal when the plunger is received.

Aspects of the example wellbore production system, which can be combined with the example wellbore production system alone or in combination, include the following. The plunger seat includes a metal seat that forms a metal-to-metal seal when the plunger is received.

Aspects of the example wellbore production system, which can be combined with the example wellbore production system alone or in combination, include the following. The biasing spring sets the cracking or opening pressure of the pressure regulator.

Aspects of the example wellbore production system, which can be combined with the example wellbore production system alone or in combination, include the following. The subsurface safety valve system is positioned downhole of the packer.

Aspects of the example wellbore production system, which can be combined with the example wellbore production system alone or in combination, include the following. The production string includes a pod at a downhole end of the production string. The pod includes an inlet at a downhole end. The inlet is defined by an outer housing of the pod. The pod also includes an interior cavity, which is defined by the outer surface of the housing. The interior cavity retains at least a portion of the electric submersible pump.

Particular implementations of the subject matter described in this disclosure can be implemented so as to realize one or more of the following advantages. The SSSV system of this disclosure uses the already available pressure downhole, produced by an ESP, to operate the SSSV instead of relying on a dedicated surface hydraulic power supply unit. Since separate surface control units and surface pumps are unnecessary, this in turn reduces the amount of equipment footprint at surface needed to operate the SSSV. The removal of such high-pressure surface hydraulic oil unit reduces machinery exposure and safety risk to operations personnel. The method of this disclosure requires minimal modifications, resulting in easy integration into existing ESP systems.

The details of one or more implementations of the subject matter described in this disclosure are set forth in the accompanying drawings and the description. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure is directed to using pressure produced by an electric submersible pump (ESP) to operate a subsurface safety valve (SSSV) without using a surface control unit or a separate pump. In order to operate a conventional SSSV system, pressure supplied from surface is used to open a safety valve so that production fluids can flow from well to surface. A hand, pneumatic, or other kind of pump supplies the hydraulic pressure to pressurize the hydraulic liquid. A hydraulic control unit or panel is also needed to be at the well site to read the supply pressures, possibly a high-pressure rating panel depending on the depth of the SSSV. A deep-set SSSV, for example, may require a hydraulic control panel rating of up to 15,000 pounds per square inch (psi). These requirements add to the overall equipment footprint and endanger personnel safety at the well site.

The subject matter in this disclosure relates to operating the SSSV using an ESP installed in the well. In some implementations, an oil-filled control line is connected between the ESP and SSSV, with the ESP placed downhole from the SSSV. Upon gradually starting the pump, for example, using a variable speed drive, the pressure developed by the ESP acts on the hydraulic oil within the hydraulic line to open the SSSV. When the pressure reaches a certain magnitude, the production fluid flows through the pump, and SSSV, to the surface. And when the ESP discharge pressure is reduced to a certain magnitude, or when the ESP is stopped, the SSSV closes and production to the surface stops. This method uses available pressure, produced by the downhole pump, to hydraulically actuate the SSSV, thereby reducing the amount of equipment needed to operate a typical SSSV system.

Figure 1:
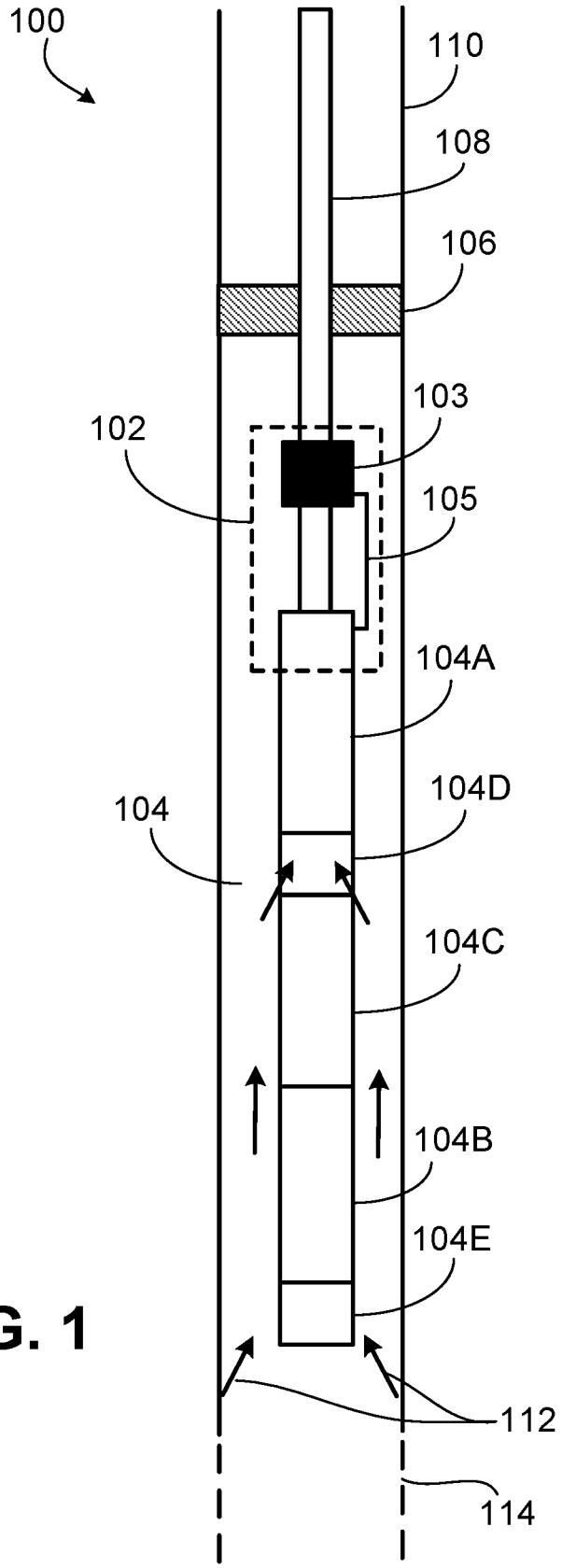
FIG. 1 is a side cross-sectional diagram of an example downhole completion system with a deep-set subsurface safety valve system using an example method of this disclosure.

FIG. 1 is a schematic of an example downhole completion system 100, where an ESP system 104 is coupled with an SSSV system 102. When installed within the wellbore, the ESP system 104 is positioned at a downhole end of a production string 108 and downhole of a packer 106. The ESP system 104 mainly includes a pump 104A and a motor 104B that is operatively coupled to the pump 104A in order to drive the pump 104A. The pump 104A is used to lift a well fluid 112, flowing from a perforation opening 114, through a pump intake 104D to the surface. In some implementations, the pump 104A can be centrifugal and can include one or more stages. Each stage adds kinetic energy to the fluid 112 and converts the energy into "head." The head generated by each individual stage is summative; hence, the total head developed by a multi-stage ESP system increases linearly from the first to the last stage. Alternatively, positive displacement pumps can be used. A protector 104C, which is located between the pump 104A and the motor 104B, absorbs the thrust load from the pump 104A, transmits power from the motor 104B to the pump 104A, equalizes pressure, and prevents well fluids 112 from entering the motor 104B. The monitoring sub 104E is installed onto the downhole end of the motor 104B to measure parameters, such as pump intake and discharge pressures, motor oil temperature and vibration, which are communicated to surface via a power cable.

A deep-set SSSV 103 is fluidically coupled to the ESP system 104 by a hydraulic line 105 filled with hydraulic fluid. The SSSV 103 is positioned uphole of the pump 104A as illustrated. In some implementations, the SSSV 103 can be integrated into the ESP system 104. In some implementations, the SSSV 103 can be a separate device. The main function of the SSSV system 102 is to prevent accidental release of hydrocarbon to the environment if well control is lost. The SSSV 103 is a "normally-closed", "fail-closed", or "fail-safe" valve that is actuated by a spring fluidically controlled by the pressurized hydraulic fluid. Normally-closed, fail-closed, and fail-safe, in the context of this disclosure, mean the valve's default state is to remain shut to prevent access of fluids when the pump 104A is not operating. Another component of the SSSV system 102 is the hydraulic line 105, which is used to control the operation of the SSSV 103. The hydraulic fluid in the hydraulic line 105 is pressurized to operate the SSSV 103 to allow the well fluid 112 produced by the ESP system 104 to flow to the surface when the pump 104A is operating under normal operating conditions. The hydraulic line 105 is made of material strong enough to withstand the pressure supplied to the hydraulic fluid. In some implementations, the hydraulic line 105 is filled with hydraulic oil, or a similar incompressible fluid.

The downhole completion system 100 includes a production string 108. The production string 108 is a wellbore tubular that is located within a casing 110 and used to produce well fluids 112. The production string 108 is made of materials compatible with the wellbore geometry, production requirements, and well fluids. Casing 110 is a tubular lowered into a wellbore and cemented in place. Casing 110 can be manufactured from a strong material, such as carbon steel, to withstand underground formation forces and chemically aggressive fluids. Casing 110 can protect fresh water formations or isolate formations with different pressure gradients. In some implementations, the SSSV system 102 and ESP system 104 are installed with a packer 106. The packer 106 is a downhole-type device secured against the casing 110 and used in completions to seal the annulus between the casing 110 and production string 108, to enable controlled production or injection.

Figure 2:
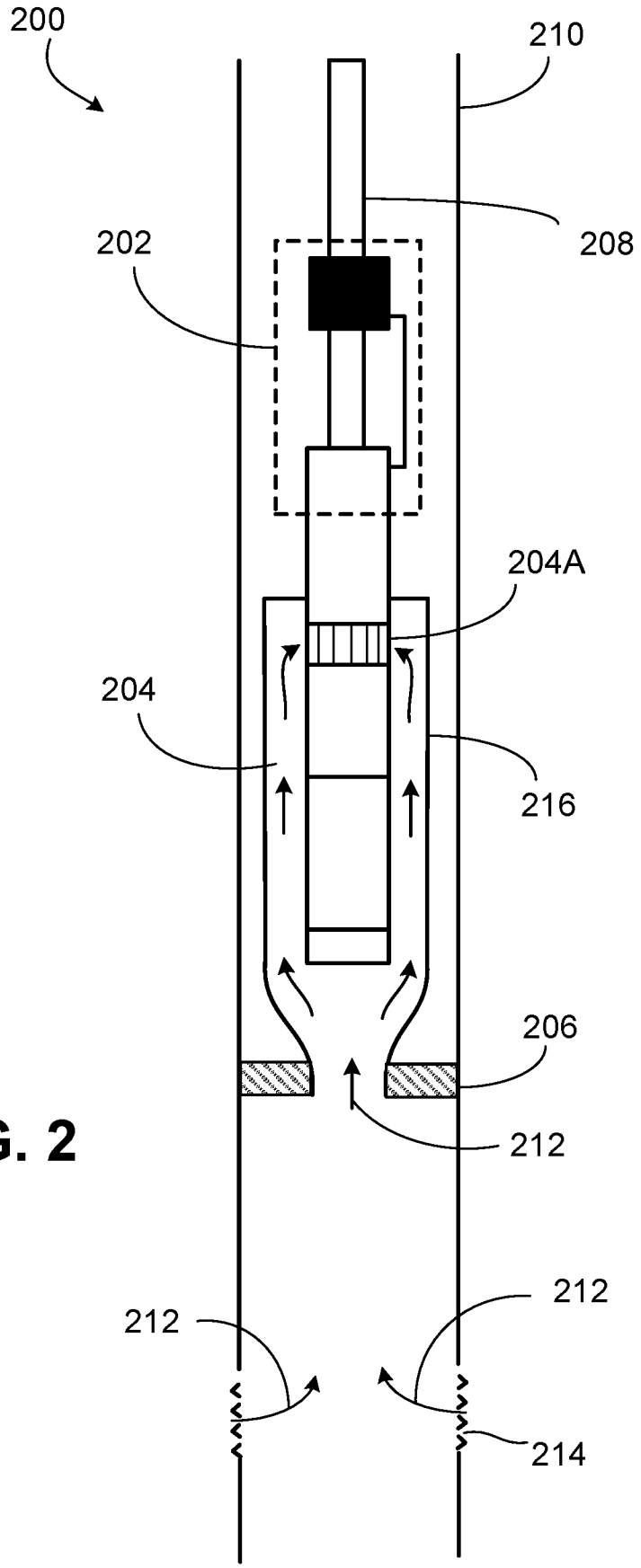
FIG. 2 is a side cross-sectional diagram of an example downhole completion system with an electrical submersible system enclosed in a pod system.

Other implementations are contemplated, as illustrated by FIG. 2, which shows an example downhole completion system 200. As illustrated, a production string 208, that includes an ESP system 204 and SSSV system 202, can be lowered into a wellbore and be positioned uphole of a packer 206. The packer 206 is positioned uphole of a perforation opening 214. The packer 206 is secured against a casing 210 to seal the annulus between the casing 210 and a pod system 216, to enable controlled production or injection. The pod system 216 extends from the packer 206, encapsulating the ESP system 204, to a certain point uphole of an intake opening 204A of the ESP system 204, to direct well fluid 212 to flow into the intake 204A. The pod system 216 can be made of material strong enough to isolate the ESP system 204 and protect the casing 210 from harsh fluids.

Figure 3A:
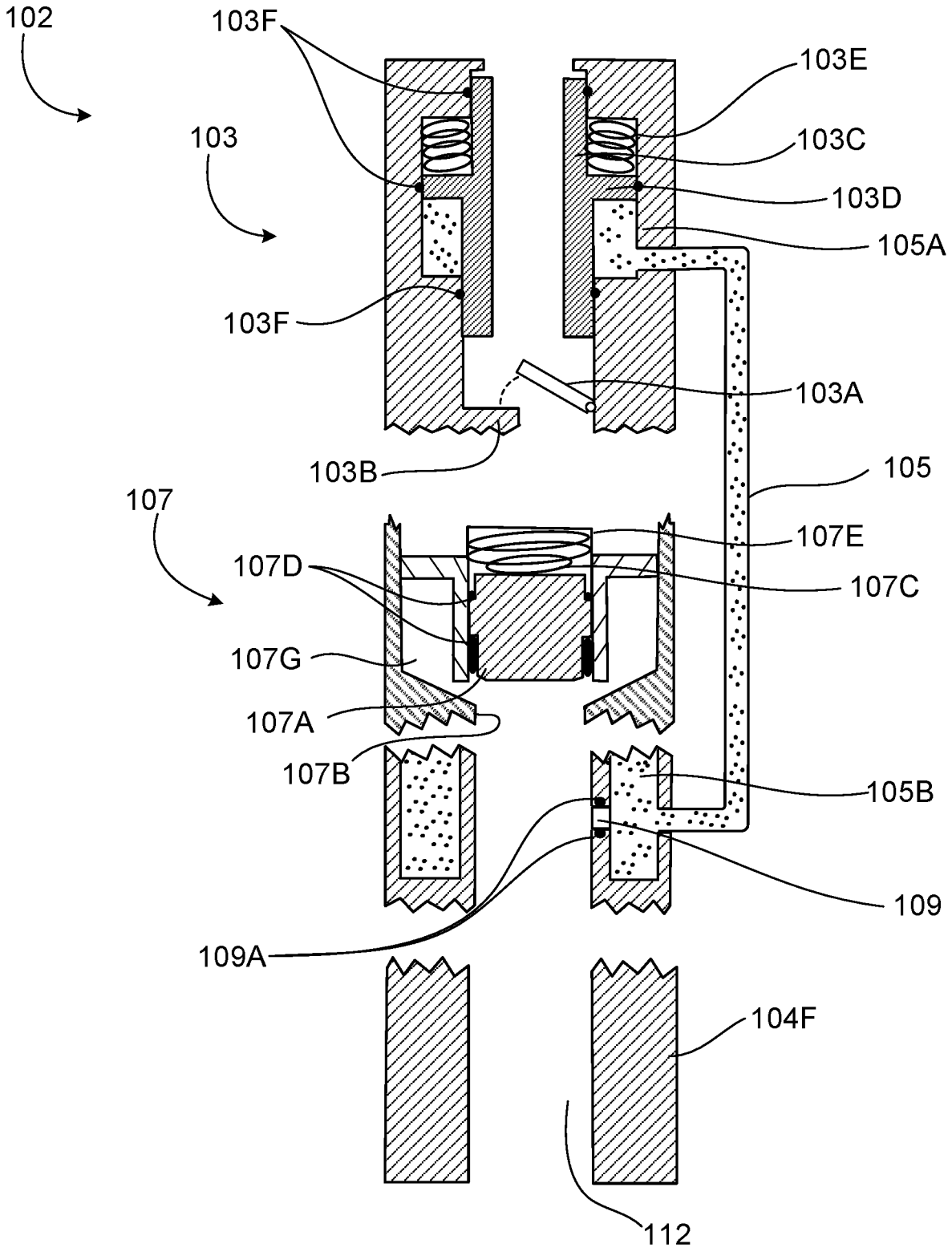
FIG. 3A is a side cross-sectional diagram of an example subsurface safety valve system of this disclosure.

FIG. 3A shows a schematic of an example SSSV system 102 of this disclosure. One main component of the SSSV system 102 is a SSSV 103. In some implementations, the SSSV 103 is a flapper-type valve. The SSSV 103 includes a flapper 103A that controls fluid flow through the SSSV 103. In a closed position, the flapper 103A seals the bore of the SSSV 103 when received by a flapper seat 103B. In some implementations, the flapper seat 103B extends from a downhole end of the housing of the SSSV 103 to receive the flapper 103A, when in a closed position. In some implementations, the flapper 103A can be a metal flapper. In some implementations, the flapper seat 103B can be a metal seat. In some implementations, the flapper 103A and flapper seat 103B form a metal-to-metal seal when the flapper is in the closed position. In some implementations, the flapper 103A, the flapper seat 103B, or both, can include a secondary seal of resilient elastomeric or thermoplastic material for low pressure sealing. In some implementations, the flapper 103A can open in an uphole or downhole direction during operation. In some implementations, elastomer seals are added to the flapper seat 103B. In some implementations, the SSSV 103 is a sliding sleeve valve. In some implementations, the SSSV 103 is a ball valve.

A sleeve 103C located adjacent to the flapper 103A maintains the flapper 103A in position against the flapper seat 103B when the SSSV 103 is in a closed position. In some implementations, the sleeve 103C is biased in a downhole direction during operation. In some implementations, the sleeve 103C is biased in an uphole direction during operation. The sleeve 103C has a shoulder 103D around an outer circumference of the sleeve 103C that is pressed against a first end of a spring 103E. The spring 103E surrounds the sleeve 103C and has a second end pressed against an inner surface of an outer housing 103 of the SSSV 103. The spring 103E is pre-set to push the sleeve 103C and shoulder 103D toward the flapper 103A to keep the SSSV 103 closed. The spring 103E is separated from a fluid bearing portion of the SSSV 103 by dynamic seals 103F. The dynamic seals 103F seal (that is, fully seal or partially seal) the annulus between the shoulder 103D and the inner surface of the outer housing 103 of the SSSV 103. The dynamic seals 103F also seal off the annulus between the sleeve 103C and the inner housing of the SSSV 103. In some implementations, the dynamic seals 103F form a metal-to-metal seal. In some implementations, the dynamic seals 103F can be elastomer seals or elastomer O-rings. To actuate the SSSV 103, a hydraulic line 105 is fluidically connected to a fluid reservoir 105A at a first end of the hydraulic fluid line. The fluid reservoir 105A is defined by the inner surface of the outer housing 103 of the SSSV 103 and the shoulder 103D. To press the spring 103E towards the inner surface of the outer housing 103 of the SSSV 103, the hydraulic fluid in the hydraulic line 105 is pressurized so that the shoulder 103D moves in an uphole direction.

Figure 3B:
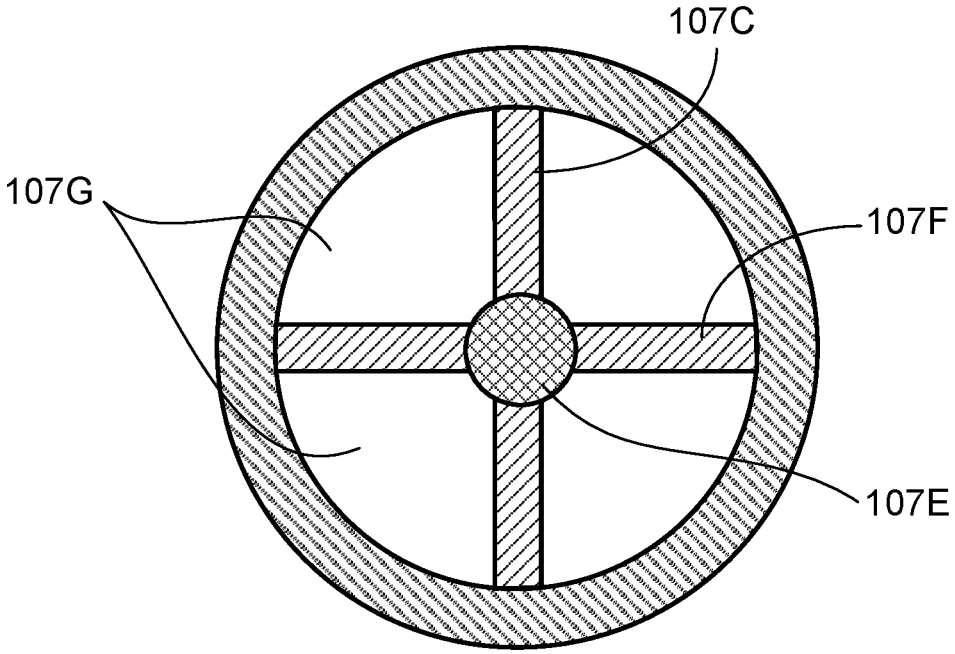
FIG. 3B is a top view diagram of an example pressure regulator of this disclosure.

The SSSV system 102 also includes a pressure regulator 107, which manages the valve opening pressure downstream of the pump discharge 104F during operation. The pressure regulator 107 ensures that the correct pressure magnitude is reached before allowing flow to the SSSV 103. The pressure regulator 107 includes a plunger 107A positioned within a flow passage downstream of the pump discharge 104F. The plunger 107A sits in a plunger seat 107B to resist flow from the pump 104A. In some implementations, the plunger seat 107B is a metal seat that forms a metal-to-metal seal when the plunger 107A is received. In some implementations, the plunger seat 107B, the plunger 107A, or both, can include a secondary seal of resilient elastomeric or thermoplastic material for low pressure sealing. In some implementations, the plunger 107A and plunger seat 107B are made from ceramic materials. In some implementations, the plunger 107A and the plunger seat 107B can be offset from the tool centerline. The plunger 107A is pressed against a biasing spring 107C on one end. The second end of the biasing spring 107C is pressed against a support structure 107E. In some implementations, the spring 107C can be a single compression spring, multiple compression springs, or nested compression springs. When the system is not in operation, the biasing spring 107C exerts a force on the plunger 107A in a downhole direction to be sealed against the plunger seat 107B. The biasing spring 107C at least partially sets the cracking or opening pressure of the pressure regulator 107. The biasing spring 107C is separated from a fluid bearing portion of the pressure regulator 107 by dynamic seals 107D. The dynamic seals 107D seal off the annulus between the plunger 107A and an inner housing of the pressure regulator 107. In some implementations, the dynamic seals 107D form a metal-to-metal seal. In some implementations, the dynamic seals 107D can be elastomer O-rings or elastomer seals. As shown by FIG. 3B, the biasing spring 107C is contained within the support structure 107E, which in turn is rigidly held by supports 107F fixed to an outer housing of the pressure regulator 107. Flow areas 107G between the supports 107F and the support structure 107E allows for well fluids 112 to flow toward the SSSV 103.

Referring back to FIG. 3A, a hydraulic piston 109 is located between the pressure regulator 107 and a discharge of ESP system 104. The hydraulic piston 109 is exposed to the pump discharge 104F during operation. Consequently, the hydraulic piston 109 pushes against a fluid reservoir 105B. The fluid reservoir 105B is located at a downhole end of the hydraulic line 105. The fluid reservoir 105B is partially surrounded and defined by a piston housing 150. In some implementations, the piston housing 150 is part of the pressure regulator 107; that is, the piston housing 150 and the pressure regulator 107 are one structure. In some implementations, the piston housing 150 is a separate structure independent from the pressure regulator 107. The hydraulic fluid in the fluid reservoir 105B is separated from the well fluid 112 produced by the pump 104A by dynamic seals 109A. The dynamic seals 109A seal off an annulus between the piston 109 and fluid reservoir 105B. In some implementations, the dynamic seals 109A form a metal-to-metal seal. In some implementations, the dynamic seals 109A can be elastomer O-rings or elastomer seals. The fluid reservoir 105B is fluidically coupled to the fluid reservoir 105A by the hydraulic line 105. Therefore, the hydraulic piston 109 displaces the hydraulic fluid up the hydraulic line 105 into the SSSV 103 in order to actuate the sleeve 103C. The sleeve actuation allows the flapper 103A to open. In some implementations, a metal bellow can be used in place of the hydraulic piston 109. In some implementations, a diaphragm can be used in place of the piston 109.

In operation, the SSSV system 102 is designed to be fail-safe to preserve the integrity of a wellbore. In the event of a catastrophic incident that damages the wellhead, the power cable of the ESP system 104 (FIG. 1) is also damaged or severed given that the wellhead has a higher structural integrity than the power cable. When the power cable is severed, electrical power from the surface to the ESP system 104 is cut-off. This power interruption automatically turns off the pump 104A (FIG. 1), causing the pump discharge pressure to decrease towards zero. Consequently, the biasing spring 107C pushes the plunger 107A into the plunger seat 107B sealing off the pressure regulator 107 to prevent well fluid 112 flow through the pressure regulator 107. Subsequently, the SSSV spring 103E pushes down on the sleeve 103C, closing the flapper 103A to stop further flow to the surface. Thus, the SSSV system 102 in this disclosure ensures a fail-safe system, to minimize the magnitude of accidental hydrocarbon release to the surface in the event of a catastrophic incident.

To close the SSSV 103 during normal operation, the motor 104B speed is reduced, the pump 104A discharge pressure reduces such that it falls below the cracking pressure of the pressure regulator 107. When this occurs, the biasing spring 107C in the pressure regulator 107 forces the plunger 107A and the lower dynamic seal of assembly 107D into the plunger seat 107B, thereby stopping fluid production to the surface. As the motor 104B speed is reduced further, the pump 104A discharge pressure decreases further until a magnitude such that the fluid force due to the hydraulic fluid is less than that of the spring 103E force of the SSSV 103. When this occurs, the spring 103E pushes down on the sleeve 103C, which pushes down on the flapper 103A and closes the bore of the SSSV 103. Since the hydraulic fluid is within a closed system, the displaced hydraulic fluid, due to the downward movement of the sleeve 103C, forces hydraulic fluid downwards into the fluid reservoir 105B. This hydraulic pressure pushes against the piston 109 to restore it to its original position.

While the ESP system 104 (FIG. 1) is shutdown, the spring 103E in the SSSV 103 pushes down on the sleeve 103C. The sleeve 103C in turn pushes down on the flapper 103A that closes the bore of the SSSV 103. In some implementations, the flapper 103A forms a metal-to-metal seal when received by the flapper seat 103B. To open the SSSV 103 and allow flow to the surface, the ESP system 104 (FIG. 1) needs to be turned on. Typical start-up of the ESP system 104 (FIG. 1) can proceed by ramping up the pump 104A (FIG. 1) at a moderate rate from rest to full speed.

Figure 4:
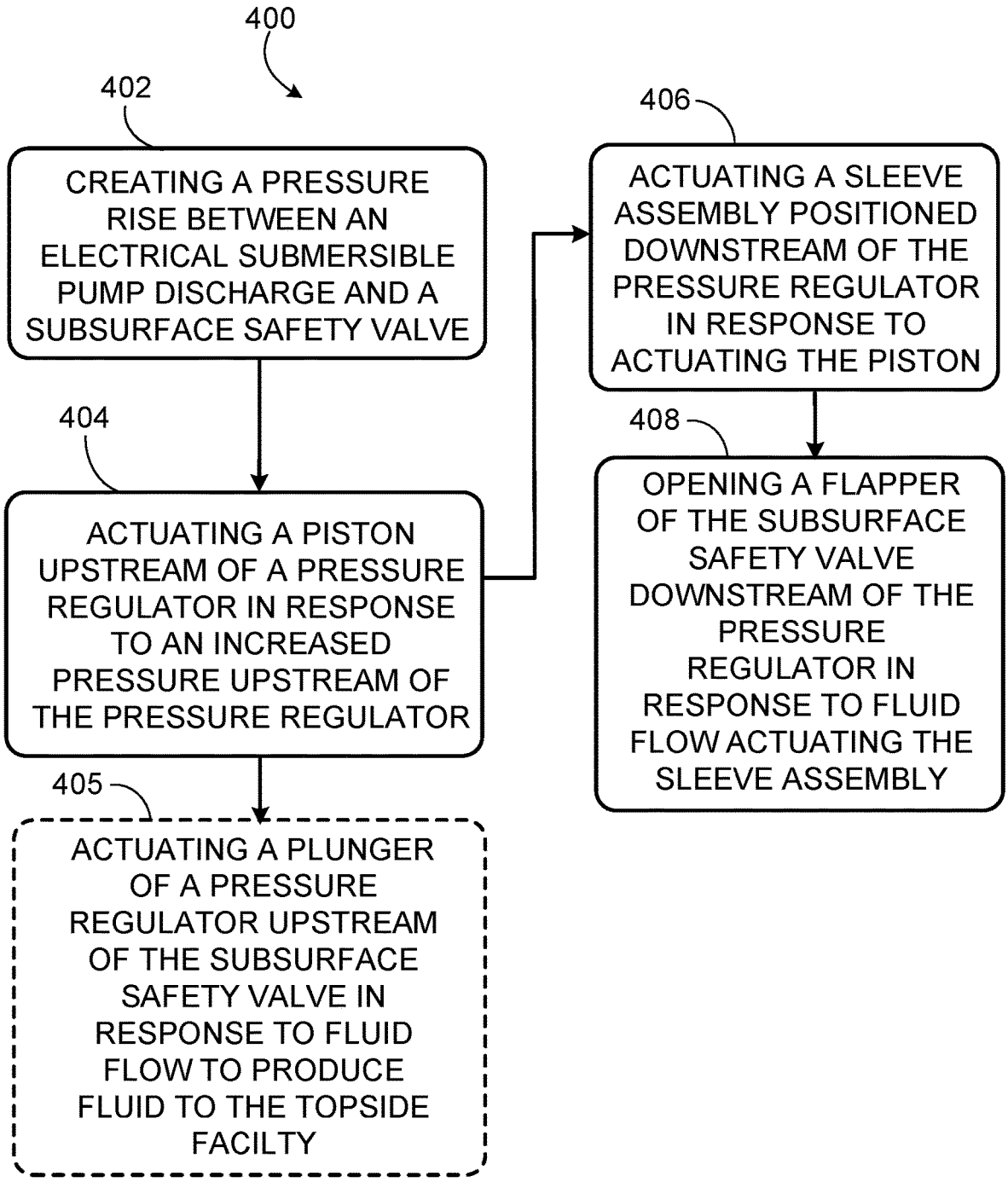
FIG. 4 is a flowchart of an example method that can be used with aspects of this disclosure.

FIG. 4 shows a flowchart of an example method 400 of how an example downhole completion system 100 works. At 402, upon starting the ESP system 104, the pump 104A develops a pressure or head against a closed pressure regulator 107. For a given pump speed, the fluid pressure between the ESP system 104 and the SSSV system 102 is highest because there is no flow to the surface. As the pump speed increases, pressure developed by the pump 104A continues increasing in order to move the plunger 107A, which, in turn, gradually approaches the cracking or opening pressure of the pressure regulator 107. In some implementations, the cracking or opening pressure is set by using the biasing spring 107C, which presses the plunger 107A into the plunger seat 107B. The sealing due to the coupling of the plunger 107A and sealing receptacle or plunger seat 107B keeps the pressure regulator 107 shut against pressure generated by the ESP system 104. The flapper 103A can also be set against the flapper seat 103B by the weight of the sleeve 103C. The sleeve 103C is pressed against the flapper 103A by the pre-set spring 103E, which keeps the SSSV 103 in a closed position.

When the SSSV 103 is blocking flow generated by the pump 104A, and if full speed of the motor 104B is reached, the discharge pressure of the pump 104A is at its highest value. However, the system is configured to operate at pressures below this highest value to prevent excessive pressure buildup and ensure smooth production flow to the surface. At 404, there is high pressure between the pump discharge 104F and the SSSV system 102. This high pressure pushes against the hydraulic piston 109 downstream of pump 104A. The piston 109 acts on the hydraulic fluid and transmits the pressure to the SSSV 103. At, 405, a plunger of the pressure regulator, upstream of the subsurface safety valve, is actuated in response to fluid flow to produce fluid to the topside facility.

At 406, this transmitted pressure pushes against the sleeve 103C downstream of the pressure regulator 107 to counteract the resisting force of the spring 103E. In some implementations, movement of the piston 109 against the fluid reservoir 105B pressurizes the hydraulic line 105 and the fluid reservoir 105A. The pressure transmitted to the fluid reservoir 105A acts against the shoulder 103D, which moves the sleeve 103C in an uphole direction against the spring 103E, in response to the increased pressure.

At 408, as the sleeve 103C presses against the spring 103E, the weight of the sleeve 103C on the flapper 103A is gradually lifted causing the flapper 103A, and SSSV 103, to open. In some implementations, the flapper 103A opens in a downstream direction. With the SSSV 103 now open and the ESP motor 104B speed reaching its operational speed, the discharge pressure of the pump 104A keeps increasing against the pressure regulator 107, which is still closed. The force due to this pressure rise acts against the force of the biasing spring 107C. When this pressure force exceeds the force of the pre-set biasing spring 107C, the plunger 107A is displaced in an uphole direction to enable flow through the pressure regulator 107 to the surface. This causes the plunger 107A to be lifted deeper into the support structure 107E, thereby creating a flow passage to allow fluid flow through the pressure regulator 107 and SSSV 103 to the surface. The pressure regulator 107 can be sized to have the opening or "cracking" pressure higher than the opening pressure of the SSSV 103. Since the pressure or head developed by the pump 104A decreases with increase in flow, the pump 104A can be sized to have a high head at near-zero flow sufficient to keep the SSSV 103 and pressure regulator 107 open during operation.

While this disclosure contains many specific implementation details, these should not be construed as limitations on the scope of any inventions or of what may be claimed, but rather as descriptions of features specific to particular implementations of particular inventions. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations described above should not be understood as requiring such separation in all implementations, and it should be understood that the described components and systems can generally be integrated together in a single product or packaged into multiple products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A subsurface safety valve system for use with an electric submersible pump, the subsurface safety valve system comprising:

a pressure regulator configured to manage a pressure downstream of a pump discharge during operation within a wellbore;

a hydraulic piston exposed to pressure upstream of the pressure regulator during operation, the hydraulic piston extending into a first fluid reservoir defined by a piston housing; and a subsurface safety valve located uphole of the electric submersible pump and fluidically coupled to the hydraulic piston, the subsurface safety valve configured to close and thereby isolate the wellbore in response to an interruption of electrical power from a surface location to the electric submersible pump, and wherein a cracking or opening pressure of the pressure regulator is higher than an opening pressure of the subsurface safety valve.

2. The subsurface safety valve system of claim 1, wherein the subsurface safety valve comprises:

a flapper;

a sleeve positioned adjacent to the flapper, the sleeve having a shoulder around an outer circumference of the sleeve, the sleeve positioned to retain the flapper against a flapper seat when the flapper is in a closed position;

a spring having a first end and a second end and surrounding the sleeve, the first end abuts the shoulder of the sleeve toward the flapper, the second end abutting an inner housing of the subsurface safety valve; and a second fluid reservoir fluidically coupled to the first fluid reservoir, the second fluid reservoir defined by the inner housing of the subsurface safety valve and the sleeve.

3. The subsurface safety valve system of claim 2, wherein the flapper seat comprises a metal seat that forms a metal-to-metal seal when the flapper is received.

4. The subsurface safety valve system of claim 2, wherein the flapper opens in an uphole direction during operation.

5. The subsurface safety valve system of claim 2, wherein the sleeve is biased in a downhole direction during operation.

6. The subsurface safety valve system of claim 2, wherein the first fluid reservoir and the second fluid reservoir are filled with hydraulic oil during operation.

7. The subsurface safety valve system of claim 1, wherein the pressure regulator comprises:

a plunger positioned within a flow passage downstream of the pump discharge when in use;

a biasing spring with a first end abutting the plunger and a second end abutting a support structure, the spring positioned to exert a force on the plunger in an upstream direction; and a plunger seat or receptacle shaped to receive the plunger and form a seal when the plunger is received.

8. The subsurface safety valve system of claim 7, wherein the biasing spring sets the cracking or opening pressure of the pressure regulator.

9. The subsurface safety valve system of claim 7, wherein the plunger seat comprises a metal seat that forms a metal-to-metal seal when the plunger is received.

10. A method comprising:

creating a pressure increase between an electric submersible pump discharge and a subsurface safety valve, the electric submersible pump located within a wellbore and the subsurface safety valve located uphole of the electric submersible pump, and wherein the subsurface safety valve is configured to close and thereby isolate the wellbore in response to an interruption of electrical power from a surface location to the electric submersible pump;

actuating a piston upstream of a pressure regulator in response to the increased pressure upstream of the pressure regulator;

actuating the subsurface safety valve responsive to actuating the piston; and actuating a plunger of the pressure regulator upstream of the subsurface safety valve in response to fluid flow to produce fluid to a topside facility, wherein a cracking or opening pressure of the pressure regulator is higher than the opening pressure of the subsurface safety valve.

11. The method of claim 10, wherein actuating the subsurface safety valve comprises:

actuating a sleeve assembly positioned downstream of the pressure regulator in response to actuating the piston; and opening a flapper valve of the subsurface safety-valve downstream of the pressure regulator in response to a fluid flow and actuating the sleeve assembly.

12. The method of claim 11, wherein the flapper valve opens in a downstream direction.

13. The method of claim 11, wherein creating a pressure increase comprises:

forcing a plunger towards a plunger seat or receptacle with a bias spring; and holding the plunger off of the plunger seat or receptacle with a fluid flow.

14. The method of claim 13, further comprising:

ceasing fluid flow through the electric submersible pump;

setting the plunger against the plunger seat or receptacle in response to the ceased fluid flow;

setting the flapper valve against a flapper seat; and holding the sleeve against the flapper valve while the flapper valve is in a closed position.

15. The method of claim 11, wherein actuating the sleeve assembly comprises:

pressurizing a chamber hydraulically coupled to the piston, by a movement of the piston, wherein one side of the chamber is a shoulder of the sleeve assembly; and moving the sleeve assembly, by the shoulder, in response to the increased pressure.

16. A wellbore production system comprising:

a production string within a wellbore;

a packer surrounding the production string, the packer sealing an annulus defined by an outer surface of the production string and an inner surface of the wellbore, the packer fluidically separating the annulus into an uphole section and a downhole section;

an electric submersible pump positioned nearer a downhole end of the production string than an uphole end of the production string;

a subsurface safety valve system positioned onto the production string uphole of the electric submersible pump, the subsurface safety valve system comprising:

a pressure regulator configured to manage pressure downstream of a pump discharge during operation;

a hydraulic piston exposed to pressure upstream of the pressure regulator during operation, the hydraulic piston extending into a first fluid reservoir; and a subsurface safety valve fluidically coupled to the hydraulic piston and configured to close and thereby isolate the wellbore in response to an interruption of electrical power from a surface location to the electric submersible pump; wherein a cracking or opening pressure of the pressure regulator is higher than an opening pressure of the subsurface safety valve.

17. The wellbore production system of claim 16, wherein the subsurface safety valve comprises:

a flapper;

a sleeve positioned adjacent to the flapper, the sleeve having a shoulder around an outer circumference of the sleeve, the sleeve positioned to retain the flapper against a flapper seat when the flapper is in a closed position;

a spring having a first end and a second end and surrounding the sleeve, the first end abuts the shoulder of the sleeve toward the flapper, the second end abutting an inner housing of the subsurface safety-valve; and a second fluid reservoir fluidically coupled to the first fluid reservoir, the second fluid reservoir defined by the inner housing of the subsurface safety valve and the sleeve.

18. The wellbore production system of claim 17, wherein the flapper seat comprises a metal seat that forms a metal-to-metal seal when the flapper is received.

19. The wellbore production system of claim 17, wherein the flapper opens in an uphole direction during operation.

20. The wellbore production system of claim 17, wherein the sleeve is biased in a downhole direction during operation.

21. The wellbore production system of claim 16, wherein the pressure regulator comprises:

a plunger positioned within a flow passage downstream of the pump discharge when in use;

a biasing spring with a first end abutting the plunger and a second end abutting a support structure, the spring positioned to exert a force on the plunger in an upstream direction; and a plunger seat or receptacle shaped to receive the plunger and form a seal when the plunger is received.

22. The wellbore production system of claim 21, wherein the plunger seat comprises a metal seat that forms a metal-to-metal seal when the plunger is received.

23. The wellbore production system of claim 21, wherein the biasing spring sets a cracking or opening pressure of the pressure regulator.

24. The wellbore production system of claim 16, wherein the subsurface safety valve system is positioned downhole of the packer.

25. The wellbore production system of claim 16, wherein the production string comprises a pod at a downhole end of the production string, the pod comprising:

an inlet at a downhole end defined by an outer housing of the pod; and an interior cavity defined by the outer surface of the housing, the interior cavity retaining at least a portion of the electric submersible pump.

* * * * *